US007684580B2

(12) United States Patent
Menzl

(10) Patent No.: US 7,684,580 B2
(45) Date of Patent: Mar. 23, 2010

(54) HEARING DEVICE TO BE AT LEAST PARTIALLY INSERTED INTO AN EAR CANAL

(75) Inventor: Stefan Daniel Menzl, Jona (CH)

(73) Assignee: Phonak AG, Stafa (CH)

( * ) Notice: Subject to any disclaimer, the term of this patent is extended or adjusted under 35 U.S.C. 154(b) by 1150 days.

(21) Appl. No.: 11/287,967

(22) Filed: Nov. 28, 2005

(65) Prior Publication Data

US 2007/0121980 A1 May 31, 2007

(51) Int. Cl.
*H04R 25/00* (2006.01)

(52) U.S. Cl. ..... 381/328; 381/322

(58) Field of Classification Search ..... 381/312, 381/322, 328; 600/25, 137
See application file for complete search history.

(56) References Cited

U.S. PATENT DOCUMENTS 4,133,984 A 1/1979 Akiyama
4,539,440 A 9/1985 Sciarra
6,256,396 B1 7/2001 Cushman
7,425,196 B2 * 9/2008 Jorgensen et al. ..... 600/25
2001/0043708 A1 11/2001 Brimhall

FOREIGN PATENT DOCUMENTS

DE 10 2004 010 866 A1 6/2005
WO 2004/100608 A2 11/2004

* cited by examiner

*Primary Examiner*—Brian Ensey
(74) *Attorney, Agent, or Firm*—Pearne & Gordon LLP

(57) ABSTRACT

The hearing device comprises an insertable part, which is to be inserted into an ear canal of a user of the hearing device. The insertable part may be identical with the hearing device itself, and the insertable part comprises a casing, which casing comprises a deformable part. The hearing device can include at least one deformable volume containing a fixed amount of a filler for changing a cross-sectional area of the deformable part. The cross-sectional area of the deformable part can be changed through changing the axial extension of the deformable part. The hearing device can include a variable volume arranged within the hearing device, the deformable part being arranged on the outside of the variable volume.

31 Claims, 2 Drawing Sheets

HEARING DEVICE TO BE AT LEAST PARTIALLY INSERTED INTO AN EAR CANAL

TECHNICAL FIELD

The invention relates to a hearing device, at least a part of which is to be inserted into an ear canal of a user wearing the hearing device. The hearing device can be a hearing aid, an earphone, a hearing protection device, a communication device or the like. Furthermore, the invention relates to a method for inserting an insertable part of a hearing device into an ear canal of a user of the hearing device, a method for taking an insertable part of a hearing device out of an ear canal of a user of the hearing device, and a method of manufacture of a hearing device.

BACKGROUND OF THE INVENTION

In-the-ear (ITE) hearing devices are, at least in part, to be worn in a user's ear canal. Usually, the geometry of the user's ear canal is precisely measured, and thereupon a hard polymer casing for housing a transducer, a signal processor, a battery and the like is produced, which casing is, accordingly, individually shaped for the user's ear canal. Nevertheless, it happens that the casing gives rise to a sore in the ear canal, due to changes in cross-section of the ear canal.

It is known from the art to provide the hard casing of an ITE hearing device with a soft coating on the outside of the casing in order to prevent such sores.

It can be advantageous to have a rather tight fit of the hearing device in the ear canal, because this reduces the risk of feedback when a high amplification gain is used. A defined opening ("vent") can provide for a defined air-penetrable connection between the inner part of the ear and the outside, which has a low risk of causing feedback. The vent equalizes pressure differences between the inside of the ear canal and the outside. The vent also suppresses the occurrence of low pressure (vacuum) in the inside of the ear canal when the hearing device is pulled out of the ear canal. Such a vacuum can occur when the ear canal is sealed by the hearing device and when the vent is plugged. This is unpleasant to the user, because the vacuum tends to pull the ear drum.

From DE 10 2004 010 866 A1, an insertion element is known, which can be connected to a behind-the-ear (BTE) hearing aid. The insertion element can support a supply line of the BTE hearing aid, which supply line can carry a signal from the BTE hearing device. The insertion element comprises a balloon, which can be filled, e.g., with a gas or a liquid, and emptied. The insertion element is inserted into a user's ear canal when the balloon is emptied. For filling the balloon, a syringe containing said gas or liquid can be connected via a tube to the balloon, and said gas or liquid can be filled into the balloon. The formerly small balloon will thereupon enlarge and adapts to the shape of the ear canal. It seems inconvenient to have to have a syringe or the like and the gas or liquid available whenever the insertion element shall be pumped up. Furthermore, it appears difficult, to properly adjust the pressure exerted on the inside of the ear canal by means of the syringe each time. In addition, it appears inconvenient to have to close the balloon (or tube) properly after filling it with the gas or liquid.

SUMMARY OF THE INVENTION

A goal of the invention is to create a hearing device that does not have the problems mentioned above. A hearing device shall be created, which avoids sores. In addition, a method for inserting an insertable part of a hearing device into an ear canal of a user of the hearing device and a method for taking an insertable part of a hearing device out of an ear canal of a user of the hearing device and a method of manufacture of a hearing device shall be provided for.

Another object of the invention is to provide for a hearing device, which prevents the build-up of an unpleasant vacuum (low pressure) in the user's ear when pulling it out of the ear canal.

Another object of the invention is to provide for a hearing device, which provides for a good and pleasant fit in the user's ear canal without the need of precisely measuring the ear canal.

Another object of the invention is to provide for a hearing device, which properly fits not only one, but a large number of ear canals.

Another object of the invention is to provide for a hearing device, which can be handled easily and safely.

Another object of the invention is to provide for a hearing device, which provides for convenient insertion and taking out.

Another object of the invention is to provide for a hearing device, which properly fits a user's ear canal even when the geometry of his ear canal, in particular the cross-section of the ear canal changes, e.g., while the user is chewing or yawning.

These objects are achieved by a hearing device and by the methods according to the patent claims.

The hearing device comprises an insertable part, which is to be inserted into an ear canal of a user of the hearing device, and which insertable part may be identical with the hearing device itself, wherein the insertable part comprises a casing, which casing comprises a deformable part, and wherein the hearing device comprises means for changing a cross-sectional area of the deformable part, which change in the cross-sectional area is reversible.

Through this the above-mentioned objects can be achieved.

The hearing device can be a hearing aid, an earphone, a hearing protection device, a communication device or the like. The hearing device can be an in-the-ear (ITE) model, in particular, an in-the-canal (ITC) model or a completely-in-the-canal (CIC) model. In case of an ITC or a CIC model, typically the insertable part of the hearing device is identical with the hearing device itself.

The casing usually forms an outer shell of the insertable part.

The means for changing a cross-sectional area of the deformable part may, e.g., allow to reduce a cross-sectional area of the deformable part before and/or while inserting the insertable part into a desired position within the ear canal (e.g., before and/or while moving the insertable part into the desired position). This way, it is easy and painless to insert the insertable part. Due to the reduced cross-sectional area no or only little friction has to be overcome during insertion. Once in the desired position, the cross-sectional area may be allowed to increase again, which allows for a proper (but soft) fit of the insertable part in the ear canal.

In another embodiment, the means for changing a cross-sectional area of the deformable part may, e.g., allow to increase a cross-sectional area of the deformable part after having inserted the insertable part into a desired position within the ear canal. Again, no or only little friction has to be overcome during insertion, and a proper fit of the insertable part in the ear canal is readily achieved.

Either the reduction of a cross-sectional area of the deformable part solely due to its deformability (made use of when inserting the insertable part into an ear canal of a smaller cross-sectional area than the cross-sectional area of the deformable part and pushing) shall not be considered a means for changing a cross-sectional area of the deformable part, or the means for changing a cross-sectional area of the deformable part according to the invention shall be considered a means for changing a cross-sectional area of the deformable part in addition to the deformability of the deformable part (made use of when inserting the insertable part into an ear canal of a smaller cross-sectional area than the cross-sectional area of the deformable part and pushing).

The means for changing a cross-sectional area of the deformable part are, in full, a part of the hearing device. While the insertable part is worn in the user's ear canal, the means for changing a cross-sectional area of the deformable part are usually, in full, worn near or in the user's ear.

The change in cross-sectional area (increase and/or reduction) achieved by means of the means for changing a cross-sectional area of the deformable part typically is reversible, since it shall usually be redone upon every insertion or pull-out of the insertable part. The change in cross-sectional area can be redoable and repeatedly achievable.

An axial coordinate of the insertable part is defined as running along the extension of the user's ear canal, when the insertable part is inserted in the ear canal, and the radial coordinate is defined as being perpendicular to the axial coordinate.

Through the axial coordinate, an axial direction is defined.

The cross-sectional area is the area of a cross-section (of the deformable part) perpendicular to the axial direction at some axial coordinate. Usually, the cross-sectional areas of cross-sections along a considerable range of axial coordinates is changed by means of the means for changing a cross-sectional area of the deformable part.

The means for changing a cross-sectional area of the deformable part can also be understood as means for changing a radial extension of the deformable part, wherein an axial coordinate of the insertable part is defined as running along the extension of the user's ear canal, when the insertable part is inserted in the ear canal, and wherein the radial coordinate is defined as being perpendicular to the axial coordinate. In this view, a generalized "diameter" of the (not necessarily roundish) deformable part is changed by means of the means.

In one embodiment, at least one section of the deformable part is to be in contact with the inside of the user's ear canal when the insertable part is inserted (to a desired position) in the user's ear canal, i.e., after the insertion of the insertable part. A pleasant fit can thus be achieved, without sores and even while chewing or yawning.

In one embodiment, the deformable part is deformable in a substantially elastic way. The deformable part can be reversibly deformable. The deformable part can be considered a flexible part. The flexible part has a flexible shape.

In one embodiment, the at least one section of the deformable part to be in contact with the inside of the user's ear canal may be in contact with the inside of the user's ear canal all the way along a cross-section of the ear canal. If a vent is provided in this embodiment, the vent shall be the only opening connecting the inside with the outside, even during chewing or yawning. The at least one section of the deformable part to be in contact with the inside of the user's ear canal may have a circumferentially arranged part, which part is to seal the user's ear canal or an inner part of the user's ear canal with respect to the outside, when the insertable part is inserted in the user's ear canal.

This reduces the risk of feedback in case that the hearing device provides for amplification of sound. The insertable part may nevertheless have a vent. The vent can provide for an equalization of a pressure difference between the inner part of the ear canal and the outside.

In one embodiment, the deformable part comprises a flexibly deformable material. The deformable part can consist substantially of a flexibly deformable material. The flexibly deformable material can be a silicone. The deformable part can comprise a silicone. The silicone can, e.g., be a biocompatible silicone or medical grade (i.e. be accepted by the human body without adverse reaction). Such silicones are well known in the field of medicine, in particular in plastic surgery. The properties of silicone, as far as stiffness, softness or gel properties are concerned, can be tailored in a wide range.

In one embodiment, the deformable part forms at least one circumferential section of the casing.

In one embodiment, the hearing device comprises means for changing the cross-sectional area of the deformable part through changing the axial extension of the deformable part. The hearing device can be constructed such that stretching or lengthening or compressing or shortening the insertable part is transformed into a change in cross-sectional area of the insertable part.

One way to implement such a transformation is by using a deformable volume containing a filler. The volume capacity of such a deformable volume remains, under conditions to which a hearing device is usually exposed, (practically) constant. An enlargement of the volume in one direction can introduce a decrease in size along another direction.

In one embodiment, the casing houses at least one deformable volume containing a filler (in particular, a substantially incompressible filler), the cross-sectional area of the at least one deformable volume being coupled to the cross-sectional area of the deformable part. The filler can comprise at least one of the group comprising a liquid, a gel, a granulate. A mixture of various of such fillers is also possible.

In one embodiment, the amount of filler remains constant during normal use of the hearing device. Normal use of the hearing device comprises inserting the insertable part into the ear canal, taking the insertable part out of the ear canal and wearing the insertable part in the ear canal.

The filler (the full amount of filler) remains after manufacture of the hearing device within the hearing device, wherein the manufacture may comprise a fitting of the hearing device to the user's ear canal, i.e., a fitter may adjust the required amount of filler to the user's needs. The user shall (or can) not change the amount of filler.

In one embodiment, the deformable part comprises a flexibly deformable material, in which the at least one deformable volume is enclosed. The flexibly deformable material can be confining the deformable volume.

In one embodiment, the means for changing the cross-sectional area of the deformable part through changing the axial extension (from now on also "length") of the deformable part comprises means for converting a mechanical force, in particular an axial force, into a change in the length of the deformable part. A mechanical force, e.g., a pressing or pulling provided by the user, may be used in order to change the length of the deformable part, thus resulting in a change in cross-sectional area. A good fit of the deformable part in the ear canal can thus be achieved.

In one embodiment, the means for changing the cross-sectional area of the deformable part through changing the axial extension of the deformable part comprises an axially movable element, which can be axially moved relative to a part of the insertable part upon a user's action. The axially movable element can be stick-like. The axially movable element can be extended at least as long as a substantial part of the axial extension of the insertable part. The axially movable element can be mechanically coupled to one end of the insertable part or one end of the hearing device.

In one embodiment, the axially movable element extends through and is movable relative to an outer end of the insertable part, which outer end is directed versus the outside of the user's ear when the insertable part is inserted in the ear canal. The outer end may be a stop for the axially movable element. The outer end may be formed by an end plate comprising a user interface, e.g., with a volume wheel, a program change button and the like. At least a part of the axially movable element can be identical with at least a part of the user interface. The outer end may be substantially rigid.

In one embodiment, the hearing device comprises a volume capacity change means for changing the cross-sectional area of the deformable part through changing the capacity of a variable volume arranged within the hearing device, the deformable part being arranged on the outside of the variable volume.

In that case, the variable volume may comprise the at least one deformable volume mentioned above.

In one embodiment, the volume capacity change means comprises a voluminous element and a deformable filler, the deformable filler being arranged within the variable volume, and the voluminous element being introducible into the variable volume, so as to cause an increase of the capacity of the variable volume, and the voluminous element being removable from the variable volume, so as to cause a decrease of the capacity of the variable volume. An increase or decrease of the volume capacity of the variable volume will lead to a change in the cross-sectional area of the deformable part.

In that case, the deformable filler may be (but not necessarily has to be) identified with the filler mentioned above.

The volume element usually has a constant (fixed) volume capacity. Its shape will usually remain unchanged during its insertion into the variable volume. It may be a solid, it may be rigid. It may be non-fluid.

In one embodiment, the deformable filler is substantially incompressible. This way a maximum change in cross-sectional area per change in volume capacity is achieved. The deformable filler can comprise at least one of the group consisting of a liquid, a gel, a granulate. It may also be a gas. It may also be a mixture of some of such substances.

In one embodiment, the voluminous element comprises at least a part of a battery and/or at least a part of a control element of the hearing device. This saves space, which is valuable, since hearing devices usually have to be very small.

In one embodiment, the volume element is introducible into the variable volume by means of at least a part of a battery door of the hearing device.

In one embodiment, the insertable part contains at least one transducer for converting electrical signals into sound.

In one embodiment, the insertable part contains at least one signal processor for sound processing.

In one embodiment, the insertable part contains at least one amplifier for amplifying audio signals in electrical form.

In one embodiment, the insertable part contains at least one transducer for converting sound into electrical signals, e.g., a microphone.

In one embodiment, the hearing device comprises a user interface comprising at least one control element, which at least one control element is at least partially identical with at least a part of the means for changing the cross-sectional area of the deformable part.

The method for inserting an insertable part of a hearing device into an ear canal of a user of the hearing device, wherein the insertable part may be identical with the hearing device itself, and wherein the insertable part comprises a casing, which casing comprises a deformable part, comprises the steps of either reducing a cross-sectional area of the deformable part by using means for changing a cross-sectional area of the deformable part, the means being comprised in the hearing device, moving the insertable part into the ear canal, and then allowing the cross-sectional area of the deformable part to increase;

or moving the insertable part into the ear canal, and then increasing the cross-sectional area of the deformable part by using means for changing a cross-sectional area of the deformable part, the means being comprised in the hearing device.

In one embodiment, said means comprise at least one deformable volume containing an amount of a filler, and the method further comprises the step of keeping said amount of said filler constant. I.e., while allowing the cross-sectional area of the deformable part to increase and when increasing the cross-sectional area of the deformable part as indicated above, respectively, the amount of filler in the hearing device remains constant.

The method for taking an insertable part of a hearing device out of an ear canal of a user of the hearing device, wherein the insertable part may be identical with the hearing device itself, and wherein the insertable part comprises a casing, which casing comprises a deformable part, comprises the steps of reducing a cross-sectional area of the deformable part by using means for changing a cross-sectional area of the deformable part, the means being comprised in the hearing device, and moving the insertable part out of the ear canal.

In one embodiment, said means comprise at least one deformable volume containing an amount of a filler, and the method further comprises the step of keeping said amount of said filler constant. I.e., while reducing a cross-sectional area of the deformable part, the amount of filler in the hearing device remains constant (is unchanged).

The method of manufacture of a hearing device comprising an insertable part, which is to be inserted into an ear canal of a user of the hearing device, and which insertable part may be identical with the hearing device itself, wherein the insertable part comprises a casing, which casing comprises a deformable part, comprises the steps of incorporating in said hearing device a means for changing a cross-sectional area of the deformable part, which change in the cross-sectional area is reversible;

incorporating in said means for changing a cross-sectional area of the deformable part at least one deformable volume, the cross-sectional area of the at least one deformable volume being coupled to the cross-sectional area of the deformable part;

incorporating in said at least one deformable volume an amount of a filler, which amount of said filler is to remain constant during normal use of the hearing device.

The method of manufacture may comprise the step of sealing said filler in a way that prevents the user from adding or removing filler, i.e., in a way that keeps the user from changing the amount of filler in the hearing device.

Further preferred embodiments and advantages emerge from the dependent claims and the figures.

BRIEF DESCRIPTION OF THE DRAWINGS

Below, the invention is described in more detail by means of examples and the included drawings. The figures show schematically.

The reference symbols used in the figures and their meaning are summarized in the list of reference symbols. The described embodiments are meant as examples and shall not confine the invention.

WAYS TO IMPLEMENT THE INVENTION

Figure 1:
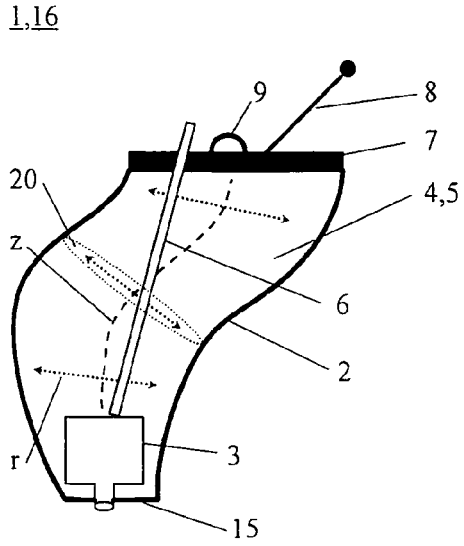
FIG. 1 a side view of a cut through an in-the-ear (ITE) hearing device, as inserted in an ear canal.

FIG. 1 schematically shows, as an example for a hearing device 1, a side view of a cut through an in-the-ear (ITE) hearing device 1, more specifically an in-the-canal (ITC) hearing device 1, as inserted in an ear canal. The hearing device 1 can be a hearing aid, an earphone, a hearing protection device, a communication device or the like.

The hearing device 1 is to be inserted fully into an ear canal. Accordingly, the hearing device 1 is identical with an insertable part 16 of the hearing device 1. In case of hearing devices comprising a remote control, a microphone that is separable from the insertable part, or the like, the insertable part 16 of the hearing device 1 would be one of several parts of the hearing device 1.

The insertable part 16 has a casing, which houses a transducer 3 (loudspeaker, receiver) and other parts of the insertable part 16, typically also a signal processor, an amplifier, a battery (not shown in FIG. 1). The casing forms an outer shell of the insertable part 16. The casing comprises an outer end 7, which is in the embodiment FIG. 1 formed by an end plate (face plate) comprising a user interface. The outer end is typically rigid. It may comprise controls 9 by means of which the user of the hearing device 1 can influence the operation of the hearing device. In FIG. 1, a volume wheel 9 is shown as an example.

A thread by means of which the insertable part 16 can be removed from the ear canal by pulling is attached to the outer end 7.

The casing furthermore has an inner end 15 and side walls, which are made of silicone 2. The side walls (and possibly also the inner end 15) form a deformable part 2 of the casing. On the inside of the deformable part 2 a deformable volume 5 is formed, which may contain a filler 4. That filler 4 can be a gel 4, e.g., a silicone gel. A deformation of the deformable part 2 will result in a deformation of the deformable volume 5.

It is possible to form the whole casing as a deformable part 2. The casing can be made of a silicone. The outer end 7 can, e.g., if it comprises a user interface, be formed from a stiffer silicone than another part of the casing, e.g., the side walls.

When the insertable part 16 is inserted in a desired position in an ear canal, the outer end 7 is located towards the outside of the ear canal, and the inner end 15 is located towards the inside of the ear canal (towards the ear drum). The dashed line indicates an approximate axis z as defined through the shape of the ear canal. The dotted arrows indicate a radial coordinate r (or radial directions), which is perpendicular to the axial coordinate z. Referring to a "length" of the insertable part 16 (or of the deformable part) refers to the axial extension of the insertable part 16 (or of the deformable part). The length may be defined as the distance between the two opposite ends 7,15 of the insertable part 16 in axial direction.

When inserted in a desired position in an ear canal (FIG. 1), the shape of the deformable part 2 is such that it touches the inside of the ear canal at least along approximately a ring, or in a more two-dimensional way. When the insertable part 16 is removed from the ear canal, a cross-sectional area 20 of the deformable part 2 would be larger than in the inserted state shown in FIG. 1. In FIG. 1 the cross-section having the cross-sectional area 20 is indicated as a dotted ellipse. The cross-section can be aligned perpendicular to the axial direction z (aligned perpendicular to one local axial direction z).

In order to allow for some ventilation between the inside of the ear canal and the outside, a small opening extending from the inner end 15 to the outer end 7 of the insertable part 16 ("vent") may be foreseen (not shown).

The insertable part 16 comprises a stick 6, which is mechanically coupled to the inner end 15 and, more precisely, to the transducer 3. The stick 6 extends through the end plate 7 and can be moved, approximately in an axial direction.

Figure 2:
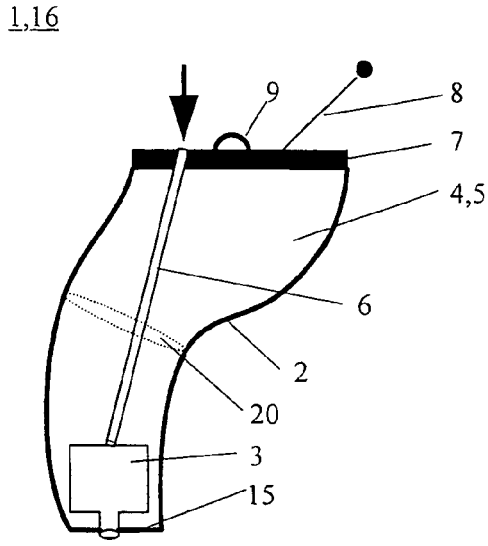
FIG. 2 a side view of a cut through a stretched in-the-ear (ITE) hearing device, as being moved into an ear canal.

FIG. 2 shows the insertable part 16 of FIG. 1 when a user pushes the stick 6 towards the inner end 15 (push indicated in FIG. 2 by the large arrow). Due to the deformability of the deformable part 2, the length of the deformable part 2 will increase. The increased length will lead to a reduced cross-sectional area 20 of the deformable part 2 (and, in fact to reduced cross-sectional areas of numerous other cross-sections nearby). Also, a radial extension of the deformable part 2, e.g., within the indicated cross-section, will be reduced.

The coupling between change in length and (opposite) change in cross-sectional area 20 can be improved when the filler 4 is substantially incompressible. The coupling can furthermore be improved by adequately forming the deformable part 2, in particular the thickness and/or the material composition of the side walls.

It is also possible to have an integrally formed deformable part 2, wherein it is furthermore possible to vary the material composition in axial and/or radial direction. In the case of silicone it is possible to vary the stiffness and deformability of the material by varying the structure of the silicone and varying the water content or other material parameters.

Upon pushing the stick 6, the deformable part 2 will be lengthened (stretched), and its cross-sectional area 20 will be reduced. In this shape (shown in FIG. 2) the user can move the insertable part 2 into the ear canal. The cross-sectional area 20 should be smaller than the cross-sectional area 20 of the ear canal at the corresponding places. When a desired position of the insertable part 16 within the ear canal is reached, the user can release the stick 6 (stop pressing against it), and the deformable part 16 will try to regain its normal (relaxed) shape and the stick 6 will, to a small extent, move back towards the outside. The cross-sectional area 20 will increase until the deformable part 2 is, at least in some places, in contact with the inner surface of the ear canal. The corresponding shape is again the shape shown in FIG. 1. The shape is usually given by the general shape of the ear canal and by the flexibility of the deformable part 2.

Instead of pushing against the transducer 3, the stick 6 could also push against the inner end 15 (possibly made from a rigid material) or against some other part of the insertable part 16 (signal processor, amplifier). It is also possible push with the stick 6 against a membrane containing the filler 4; in that case, the size of the stick or the size of a piston attached to the stick 6 may be changed in order to change the stretching achieved by exerting a certain force on the stick 6.

In another embodiment, similar to the one of FIGS. 1 and 2, the normal (relaxed) shape of the insertable part 16 could be like the one shown in FIG. 2 (thin and long). After having moved the insertable part into a desired position within the ear canal, the user could then pull the stick 6 in order to decrease the length of the deformable part 2, and the cross-sectional area 20 would increase so as to provide for a proper fit of the insertable device 16 in the ear canal. The shape would then be as shown in FIG. 1. The stick 6 would be fixed to the transducer 3 or another part of the insertable part 16. In the final, pulled position (compare FIG. 1), the stick 6 could be fixed, e.g., by means of a little hook or by squeezing it into a slit in the opening of the end plate 7. When the axially movable element 6 is to be pulled by the user, it could also be a thread instead of a stick 6. This mechanism may be mechanically combined with a battery door of the hearing device and/or with the thread 8.

Instead of by mechanical means as shown in FIGS. 1 and 2, a force for changing the shape (cross-sectional area, and possibly also length) of the deformable part 2 could also be otherwise provided for; e.g., magnetically, by incorporating at least one small powerful (permanent) magnet in the insertable part (towards the inner end 15). A user can use another magnet (oppositely poled or equally poled) to force a change in the length or, if the magnet arrangement is chosen appropriately, to change directly the cross-sectional area of the deformable part. The shape of the deformable part 2 could also be changed by using piezoelectricity or others.

Another mechanical way of changing (reducing) the cross-sectional area of the deformable part is to incorporate a thread in the deformable part 2. The thread can form a circumferentially arranged sling, the cross-sectional area of which can be reduced by pulling an end of the thread, which extends out of the insertable part. The thread can at the same time be used as a pull-out means 8 (pull-out means are shown in FIGS. 1 and 2).

Figure 3:
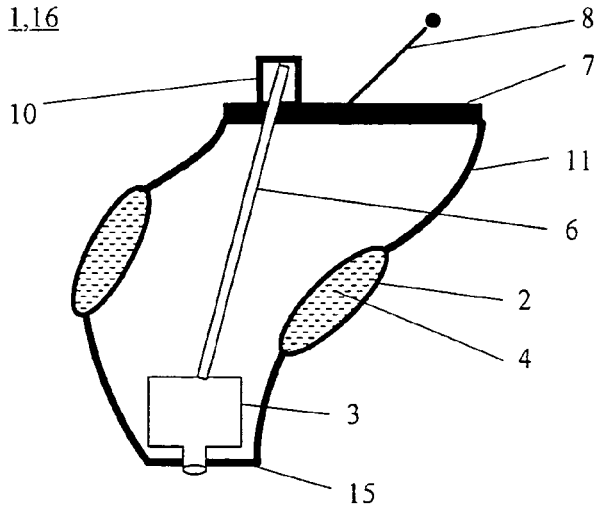
FIG. 3 a side view of a cut through an in-the-ear (ITE) hearing device with a gel-filled toroid, as inserted in an ear canal.

The embodiment shown in FIG. 3 is similar to the one of FIGS. 1 and 2. But the casing comprises, besides the deformable part 2, also a rigid part 11. The shape of the rigid part 11 will not (or at least not substantially) change during insertion or pull-out of the insertable part 16. The deformable part 2 has an approximately toroidal shape. It is circumferentially arranged on the outside of the insertable part 16. The deformable part 2 may be made from one flexibly deformable material, or it may comprise a deformable shell 2, which contains a filler 4, as shown in FIG. 3 (similar to the filler 4 in the insertable part 16 of FIGS. 1 and 2). The filler 4 can be a gas, which, for the applied forces, is still practically incompressible, or the filler is a flexibly deformable substantially incompressible material like a viscous material, e.g., a liquid or a gel, or a granulate or a combination thereof.

The stick 6 is partially identical with a user control 10, which can, e.g., be a program change button of the hearing device 1. For insertion of the insertable part 16 into the ear canal, the user presses the button 10 and therewith moves the stick 6. This will exert an axially directed force on the transducer 3, leading to an axial lengthening of the deformable part 2. The incompressibility of the filler 4 ensures that the axial lengthening of the deformable part 2 results in a decreased cross-sectional area of the deformable part 2. The insertable part 16 can be easily inserted into a desired position, and upon releasing the button 10, the cross-sectional area of the deformable part will increase, leading to a proper fit of the insertable part within the ear canal.

Instead of one such approximately ring-shaped section, the deformable part 2 may as well comprise two or three such sections. At least one, may be several or all of them can, in the inserted state, be in contact with the inner surface (skin) of the ear canal.

Instead of sealing the inner part of the ear canal from the outer part by means of the deformable part 2, it is also possible to not fully close the interface between the inner surface of the ear canal and the deformable part 2, so that an opening remains (or openings remain), extending from the inner end 15 of the insertable part 16 to the outer end 7 and connecting the inner part of the ear canal with the outside. This can, e.g., be accomplished by providing the deformable part 2 with one, two, three or more incomplete, approximately toroidal shaped parts (e.g., half-rings) at different axial positions; or by leaving at least one opening within the deformable part 2, which extends from the inner end 15 of the insertable part 16. In such embodiments, a vent can be dispensed with.

Figure 4:
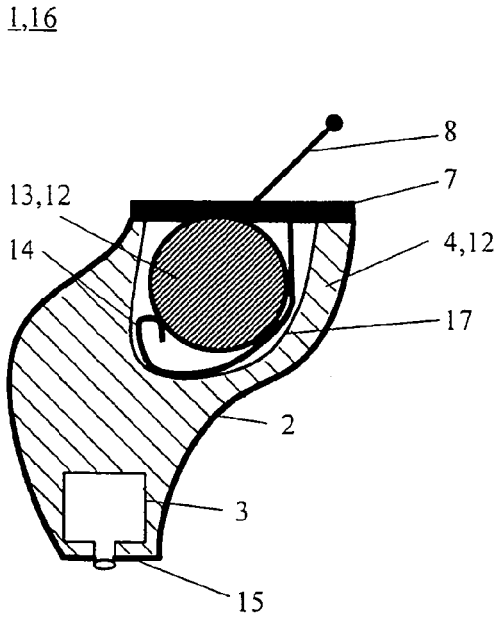
FIG. 4 a side view of a cut through an in-the-ear (ITE) hearing device, as inserted in an ear canal.

FIG. 4 shows schematically a side view of a cut through an in-the-ear (ITE) hearing device 1, as inserted in an ear canal.

Figure 5:
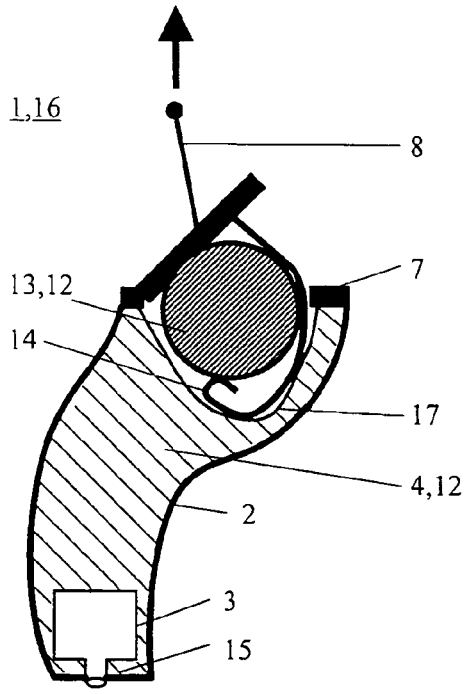
FIG. 5 a side view of a cut through an in-the-ear (ITE) hearing device, as being moved out of an ear canal.

FIG. 5 shows the same hearing device 1, but as being moved out of an ear canal.

The hearing device 1 of FIGS. 4 and 5 is similar to that in FIGS. 1 to 3, but the way of changing the cross-sectional area 20 of the insertable part 16 is different. In FIG. 4, a battery 13 is shown, being contained in the hearing device 1, and more precisely, being contained in the insertable part 16. The battery 13 is held by a spring 14. In FIG. 5 is shown that the battery can be removed from the insertable part 16.

The casing contains a variable volume 12, which comprises, when the insertable part 16 is in a desired position in the ear canal, the battery 13 and a filler 4, e.g., a gel, (see FIG. 4). When removing the insertable part 16 from the ear canal, the battery 13 is, at least partially, removed from the variable volume 12, having the effect that the volume capacity of the variable volume 12 is reduced (see FIG. 5). The filler 4 remains within the variable volume 12 and can remain within the insertable part 16.

The filler 4 can be a gas, which, for the applied forces, is still practically incompressible, or the filler is a flexibly deformable substantially incompressible material like a viscous material, e.g., a liquid or a gel, or a granulate or a combination thereof. The latter materials can more easily be kept within the variable volume 12 than a gas.

The shape of the soft shell 2 in the relaxed (equilibrium) state is rather thin, so that upon reducing the variable volume 12 by taking out the battery 13, the shape of the deformable part 2 changes from the shape shown in FIG. 4 to approximately the shape shown in FIG. 5. Accordingly, the decreased volume capacity within the insertable part 16 leads to a decreased cross-sectional area of the deformable part 2. The insertable part 16 can be easily removed from the ear canal.

FIG. 5 shows that the pulling-out of the insertable part 16 can be coupled to the opening of a battery compartment. Both can be accomplished by pulling the thread 8.

Depending on the stability and/or chemical properties of the filler 4, it can be advisable to foresee a membrane 17 in the insertable part 16, which separates the filler from the battery 13.

For inserting an insertable part 16 according to FIGS. 4 and 5 into the operating position in an ear canal, the battery 13 is (or remains) removed from the variable volume 12 (which variable volume 12 is arranged inside the insertable part 16) while the insertable part 16 is moved into or within the ear canal. Once the desired depth within the ear canal is (approximately) reached, the battery 13 is pushed into the variable volume 12. The increased capacity of the variable volume 12 causes an increased cross-sectional area of the deformable part 2, so that a proper fit is achieved. In order to let an increase of the capacity of the variable volume 12 result rather in an increase of the cross-sectional area than in an increase of the length, the equilibrium shape of the deformable part 2 can be chosen correspondingly and/or the wall thickness distribution of the deformable part 2 and/or the material composition at the deformable part 2. It is also possible to choose a filler 4 that has itself an equilibrium shape, which prefers, upon inserting the battery 13 into the variable volume 12, an increase of the cross-sectional area of the deformable part 2 over an increase of the length. The amount of "volume increase" can easily be controlled at production (e.g., through the amount of filler inserted) and can be altered later by a fitter, e.g., by applying appropriate elements (e.g., gluing small flat polymer or metal pieces) to the membrane 17 or to the battery holding mechanism 14.

The relaxed (equilibrium) shape of the deformable part can, in all the embodiments with a filler 4, either be predominantly determined by the outer shell 2 housing the filler, or be predominantly determined by the shape of the filler, or be determined by both, the filler 4 and the shell 2.

Instead of a battery 13, also another voluminous element 14 can be used for changing the capacity of the variable volume 12; e.g., a knob or button.

Of course, the way of changing the cross-sectional area 20 through varying a volume capacity of a volume 12, as discussed in conjunction with FIGS. 4 and 5, is not confined to hearing devices 1, the side walls of which in full are flexibly deformable. It is also possible to use this way when the deformable part 2 is designed to form only a part of the side wall, e.g., like discussed in conjunction with FIG. 3.

The deformable part 2 allows to use one insertable part 16 for a multitude of ear canal geometries. The ear canal does not have to be measured with high precision. It is therefore possible to use a number (of the order of 10 to 50) of insertable parts 16 with standard geometries (standard shapes), with which the ear canals of nearly all users can be properly fitted.

The means for changing a cross-sectional area 20 of the deformable part 2 can be means for changing a cross-sectional area 20 of the deformable part 2 before inserting the insertable part 16 into a desired position within an ear canal; see, e.g., FIGS. 1 and 2. While moving the insertable part 16 within the ear canal, the cross-sectional area 20 may be kept at a changed value by the means for changing a cross-sectional area 20 of the deformable part 2.

The means for changing a cross-sectional area 20 of the deformable part 2 can be means for changing a cross-sectional area 20 of the deformable part 2 when the insertable part 16 is in a desired position (depth) within an ear canal and keeping the cross-sectional area 20 in that position approximately constant.

It is possible to decrease the cross-sectional area 20 of the deformable part 2 by using means of the hearing device, like those shown in FIGS. 1 to 5, when removing the insertable part 16 from the ear canal. It is also possible to pull the insertable part 16 out of the ear canal without using such means. In the latter case it is desirable to avoid the build-up of a vacuum near the user's ear drum. This task can be accomplished by forming such sections of the deformable part 2, which are located closer to the outer end 7, thinner and/or from easier deformable material than sections of the deformable part 2 located closer to the inner end 15. In this way, a reduction in cross-sectional area 20 upon pulling-out is to be expected first at those outer sections, and later in sections with thicker and/or stiffer material located closer to the ear drum.

LIST OF REFERENCE SYMBOLS

1 hearing device, in-the-ear hearing device
2 deformable part of casing, silicone, soft shell
3 transducer, receiver, loudspeaker
4 filler, gel
5 deformable volume
6 axially movable element, stick, push-button
7 outer end of the insertable part, user interface, outer end plate
8 pull-out means, thread, silicone thread
9 control element, volume wheel control element, button, knob, program chance button
11 rigid part of casing
12 variable volume
13 energy reservoir, battery, voluminous element
14 battery holding mechanism, spring inner end of insertable part
16 insertable part of the hearing device
17 membrane
20 cross-section of deformable part, cross-sectional area
r radial coordinate
z axial coordinate, length

The invention claimed is:

1. Hearing device comprising an insertable part to be inserted into an ear canal of a user of the hearing device, wherein the insertable part comprises a casing, wherein the casing comprises a deformable part, wherein the hearing device further comprises means for changing a cross-sectional area of the deformable part, wherein the change in the cross-sectional area is reversible, and when worn in the ear canal and said cross-sectional area is relatively large, the insertable part is extended generally along a curved line defined through the shape of the ear canal, and during insertion into the ear canal with said cross-sectional area relatively small, the insertable part is extended generally along a curved line, which is said curved line defined through the shape of the ear canal, stretched in the range of the deformable part.

2. The hearing device according to claim 1, wherein at least a section of the deformable part is to be in contact with the inside of the user's ear canal when the insertable part is inserted in the user's ear canal.

3. The hearing device according to claim 1, wherein the at least one section has a circumferentially arranged part, wherein the circumferentially arranged part is to seal the user's ear canal or an inner part of the user's ear canal with respect to the outside.

4. The hearing device according to claim 1, wherein said means for changing a cross-sectional area of the deformable part comprises at least one deformable volume containing an amount of a filler, the cross-sectional area of the at least one deformable volume being coupled to the cross-sectional area of the deformable part.

5. The hearing device according to claim 4, wherein said amount of said filler is constant during a normal use of the hearing device.

6. The hearing device according to claim 4, wherein the filler comprises at least one selected from the group consisting of a liquid, a gel, and a granulate.

7. The hearing device according to claim 4, wherein the deformable part comprises a flexibly deformable material, in which the at least one deformable volume is enclosed.

8. The hearing device according to claim 1, wherein the hearing device comprises means for changing the cross-sectional area of the deformable part through changing an axial extension of the deformable part, wherein the axial coordinate of the insert able part is defined as running along the extension of the user's ear canal, when the insertable part is inserted in the ear canal, and wherein the radial coordinate is defined as being perpendicular to the axial coordinate.

9. The hearing device according to claim 8, wherein the means for changing the cross-sectional area of the deformable part through changing the axial extension of the deformable part comprises means for converting a mechanical force into a change in the axial extension of the deformable part.

10. The hearing device according to claim 9, wherein the means for changing the cross-sectional area of the deformable part through changing the axial extension of the deformable part comprises an axially movable element.

11. The hearing device according to claim 10, wherein the axially movable element is stick-like and/or is extended at least as long as a substantial part of the axial extension of the insertable part.

12. The hearing device according to claim 10, wherein the axially movable element extends through and is movable relative to an outer end of the insertable part, wherein the outer end is directed versus the outside of the user's ear when the insertable part is inserted in the ear canal.

13. Hearing device comprising an insertable part to be inserted into an ear canal of a user of the hearing device, wherein the insertable part comprises a casing, wherein the casing comprises a deformable part, wherein the hearing device further comprises means for changing a cross-sectional area of the deformable part, wherein the change in the cross-sectional area is reversible;

wherein the hearing device comprises a volume capacity change means for changing the cross-sectional area of the deformable part through changing the capacity of a variable volume arranged within the hearing device, the deformable part being arranged on the outside of the variable volume.

14. The hearing device according to claim 13, wherein the volume capacity change means comprises a voluminous element and a deformable filler, the deformable filler being arranged within the variable volume, and the voluminous element being introducible into the variable volume, so as to cause an increase of the capacity of the variable volume, and the voluminous element being removable from the variable volume, so as to cause a decrease of the capacity of the variable volume.

15. The hearing device according to claim 14, wherein the deformable filler is substantially incompressible.

16. The hearing device according to claim 14, wherein the deformable filler comprises at least one selected from the group consisting of a gas, a liquid, a gel, and a granulate.

17. The hearing device according to claim 14, wherein the voluminous element comprises at least a part of a battery and/or at least a part of a control element of the hearing device.

18. The hearing device according to claim 1, wherein the insertable part comprises at least one transducer for transducing electrical signals into sound.

19. The hearing device according to claim 1, wherein the insertable part comprises at least one signal processor for sound processing.

20. The hearing device according to claim 1, wherein the hearing device comprises a user interface comprising at least one control element, wherein the at least one control element is at least partially identical with at least a part of the means for changing the cross-sectional area of the deformable part.

21. The hearing device according to claim 1, wherein the hearing device is a hearing aid.

22. Method for inserting an insertable part of a hearing device into an ear canal of a user of the hearing device, wherein the insertable part comprises a casing, wherein the casing comprises a deformable part, the method comprising the steps of either:

reducing a cross-sectional area of the deformable part by using a means for changing a cross-sectional area of the deformable part, the means being comprised in the hearing device, thereby stretching the deformable part such that the insertable part is extended generally along a curved line, which is a curved line defined through the shape of the ear canal, stretched in the range of the deformable part;

moving the insertable part into the ear canal; and then allowing the cross-sectional area of the deformable part to increase, thereby allowing the insertable part to take a shape extending generally along a curved line defined through the shape of the ear canal;

or moving the insertable part having a shape extending generally along a curved line, which is a curved line defined through the shape of the ear canal, stretched in the range of the deformable part, into the ear canal; and then increasing the cross-sectional area of the deformable part by using means for changing a cross-sectional area of the deformable part, the means being comprised in the hearing device, thereby shortening the deformable part such that the insertable part is extended generally along a curved line defined through the shape of the ear canal.

23. The method according to claim 22, wherein said means comprises at least one deformable volume containing an amount of a filler, the method further comprising the step of keeping said amount of said filler constant.

24. Method for taking an insertable part of a hearing device out of an ear canal of a user of the hearing device, wherein the insertable part comprises a casing, wherein the casing comprises a deformable part, the method comprising the steps of:

reducing a cross-sectional area of the deformable part by using a means for changing a cross-sectional area of the deformable part, the means being comprised in the hearing device, thereby either stretching the deformable part such that the insertable part is extended generally along a curved line, which is a curved line defined through the shape of the ear canal, stretched in the range of the deformable part;

or allowing the insertable part to take a shape extending generally along a curved line, which is a curved line defined through the shape of the ear canal, stretched in the range of the deformable part; and moving the insertable part out of the ear canal.

25. The method according to claim 24, wherein said means comprises at least one deformable volume containing an amount of a filler, the method further comprising the step of keeping said amount of said filler constant.

26. Method of manufacture of a hearing device comprising an insertable part to be inserted into an ear canal of a user of the hearing device, wherein the insertable part comprises a casing, wherein the casing comprises a deformable part, said method comprising the steps of:

incorporating in said hearing device a means for changing a cross-sectional area of the deformable part, wherein the change in the cross-sectional area is reversible, and when worn in the ear canal and said cross-sectional area is relatively large, the insertable part is extended generally along a curved line defined through the shape of the ear canal, and during insertion into the ear canal with said cross-sectional area relatively small, the insertable part is extended generally along a curved line, which is said curved line defined through the shape of the ear canal, stretched in the range of the deformable part;

incorporating in said means for changing a cross-sectional area of the deformable part at least one deformable volume, the cross-sectional area of the at least one deformable volume being coupled to the cross-sectional area of the deformable part; and incorporating in said at least one deformable volume an amount of a filler, wherein the amount of said filler is to remain constant during normal use of the hearing device.

27. The hearing device according to claim 1, wherein the insertable part is identical with the hearing device itself.

28. The hearing device according to claim 10, wherein the axially movable element is axially movable relative to a part of the insertable part upon a user's action.

29. The method according to claim 22, wherein the insertable part is identical with the hearing device itself.

30. The method according to claim 24, wherein the insertable part is identical with the hearing device itself.

31. The method according to claim 26, wherein the insertable part is identical with the hearing device itself.

* * * * *

UNITED STATES PATENT AND TRADEMARK OFFICE

CERTIFICATE OF CORRECTION

PATENT NO. : 7,684,580 B2
APPLICATION NO. : 11/287967
DATED : March 23, 2010
INVENTOR(S) : Stefan Daniel Menzl It is certified that error appears in the above-identified patent and that said Letters Patent is hereby corrected as shown below:

Column 9, line 6, please replace "may be" with -- maybe --

Column 12, line 15-16, please remove "control element, volume wheel control element, button, knob, program chance button" and replace with:

-- 9 control element, volume wheel --
-- 10 control element, button, knob, program chance button --

Column 12, line 20-21, please remove "battery holding mechanism, spring inner end of insertable part" and replace with:

-- 14 battery holding mechanism, spring --
-- 15 inner end of insertable part --

In the claims column 13, line 3, please replace "insert able" with -- insertable --

Signed and Sealed this

Tenth Day of August, 2010

David J. Kappos

David J. Kappos
*Director of the United States Patent and Trademark Office*